US006971518B1

(12) United States Patent
Lowry

(10) Patent No.: US 6,971,518 B1
(45) Date of Patent: Dec. 6, 2005

(54) PALLET BASE PACKAGING SYSTEM

(75) Inventor: James W. Lowry, Franklin, TN (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/711,687

(22) Filed: Sep. 30, 2004

Related U.S. Application Data

(60) Provisional application No. 60/576,714, filed on Jun. 3, 2004.

(51) Int. Cl.[7] ..... B65D 19/44; B65D 19/38; B65D 21/00; A47F 7/00

(52) U.S. Cl. ..... 206/386; 108/53.1; 206/499; 206/589; 206/593; 211/59.4; 211/74

(58) Field of Search ..... 206/499–500, 206/386, 427, 497, 521, 526, 597, 459.5, 206/589, 593; 53/443, 447, 475; 108/53.1–53.5; 211/59.4, 74

(56) References Cited

U.S. PATENT DOCUMENTS

| | | | | | |
|---|---|---|---|---|---|
| 601,326 | A | * | 3/1898 | Record | 206/499 |
| 3,039,881 | A | * | 6/1962 | Shapiro | 206/499 |
| 3,627,122 | A | * | 12/1971 | Garbe, Jr. | 206/459.5 |
| 3,799,382 | A | * | 3/1974 | Munroe | 108/55.1 |
| 3,961,707 | A | * | 6/1976 | Lehr et al. | 206/386 |
| 4,130,978 | A | * | 12/1978 | Cohen | 206/499 |
| 4,292,901 | A | * | 10/1981 | Cox | 206/597 |
| 4,516,677 | A | * | 5/1985 | Rowland et al. | 206/499 |
| 4,653,651 | A | * | 3/1987 | Flum | 211/59.4 |
| 4,667,823 | A | | 5/1987 | Wolfe et al. | |
| 4,801,024 | A | | 1/1989 | Flum et al. | |
| 4,865,202 | A | | 9/1989 | Day | |
| 5,016,761 | A | | 5/1991 | Stoddard et al. | |
| 5,035,323 | A | | 7/1991 | Daniels et al. | |
| 5,144,897 | A | | 9/1992 | Avery | |
| 5,251,753 | A | | 10/1993 | Pigott et al. | |
| 5,634,555 | A | * | 6/1997 | Dunham | 206/499 |
| 5,647,284 | A | * | 7/1997 | Frysinger et al. | 108/53.1 |
| 5,896,995 | A | | 4/1999 | Murray et al. | |
| 5,918,751 | A | | 7/1999 | Kelly | |
| 5,938,036 | A | | 8/1999 | Villemure | |
| 6,267,255 | B1 | | 7/2001 | Brush | |

FOREIGN PATENT DOCUMENTS

| | | |
|---|---|---|
| JP | 10167253 | 6/1998 |

* cited by examiner

*Primary Examiner*—Bryon P. Gehman
(74) *Attorney, Agent, or Firm*—Clausen Miller, P.C.

(57) ABSTRACT

A modular packaging system for shipping and displaying vertically stacked product containers. The system comprises a top cap, a plurality of corrugated trays with openings formed therein for receiving the bottoms of the product containers and restricting their movement, a bottom tray, a pallet, and vertical support posts that key inside the bottom tray and top cap and through the middle trays to help lock the system together. The entire assembly may be held together with banding and wrapped in a transparent plastic film to protect the product from dust and damage during shipment.

16 Claims, 3 Drawing Sheets

PALLET BASE PACKAGING SYSTEM

This application claims the benefit of U.S. Provisional Ser. No. 60/576,714 filed Jun. 3, 2004.

FIELD OF THE INVENTION

This patent relates to a modular packaging system for shipping and displaying palletized stackable retail products. More particularly, this patent relates to a system for packaging and displaying stackable products that unitizes the pallet load to prevent funneling.

DESCRIPTION OF THE RELATED ART

Mass merchandising retailers such as club store retailers often display their products on the pallets the products were shipped on from the vendors. The products in their containers (what the consumer actually buys) are arranged in multiple layers and mounted on pallets.

Some products, like granular detergent, can be packaged in tapered bucket type containers. These containers are then stacked on a pallet, often directly on top of each other to form multiple layers (rows) of containers. It is not unusual to have five or six layers of containers stacked on top of each other. A top cap is often placed over the top layer of containers and the entire assembly wrapped in transparent stretch film. Optional corrugated trays may be placed between the rows of containers for added structural support.

In stretch wrapped units, given the taper of the product containers, vibration during shipping can cause the containers on the lower layers to shift closer together, creating a palletized unit having a funnel shape that is larger at the top than at the bottom. This "funneling" results in an uneven load distribution, which puts undue stress on the containers and can cause them to crack and leak product onto the pallet and floor of the truck, warehouse, and retail store. The damage caused by ruptured containers can cost the customer money and produce an unsafe situation for the customer.

Thus an object of the present invention is to provide packaging system for the shipping and display of palletized stacked products that keeps the product containers neatly stacked in vertical columns on the pallet.

Another object of the invention is to provide a packaging system that allows the product containers to move slightly during shipping but restricts greater lateral movement to prevent damage to the individual containers.

Yet another object of the invention is to provide a packaging system that links the product containers and container columns together to help distribute and control the abusive forces that occur during shipping and handling.

Still another object of the invention is to provide a packaging system for palletized products that allows for stacking of multiple palletized units.

Further and additional objects will appear from the description, accompanying drawings, and appended claims.

SUMMARY OF THE INVENTION

A packaging system for shipping and displaying multiple layers of vertically stacked product containers is provided. The product containers may be generally frusto-conical in shape and have a larger diameter at the top than at the bottom. The system comprises a top cap, a plurality of corrugated trays with openings formed therein for receiving the bottoms of the product containers and restricting their movement, a bottom tray, a pallet, and vertical support posts that key inside the bottom tray and top cap and through the middle trays to help lock the system together. The entire assembly may be held together with banding and wrapped in a transparent plastic film to protect the product from dust and damage during shipment.

Preferably, each tray comprises a center panel having an array of circular openings disposed therein for receiving and restricting the movement of the product containers. The openings are larger than the bottom diameter of the product containers but smaller than the top diameter of the product containers so that each tray rests on the tops of a layer of product containers. Each tray also comprises corner openings for receiving the vertical support posts. The vertical support posts are inserted through the corner openings to lock the trays 14 together.

The bottom tray comprises a center panel and short side panels extending upward from the center panel and typically rests on the pallet. The top cap comprises a center panel and short side panels extending downward from the center panel. The top cap is configured to fit over upper ends of the vertical support posts.

Vertical banding may be placed around the top cap and pallet to secure the system during shipping and handling and transparent plastic film may be wrapped around the system to protect the product containers from dust and damage.

THE DRAWINGS

DETAILED DESCRIPTION OF THE INVENTION

Figure 1:
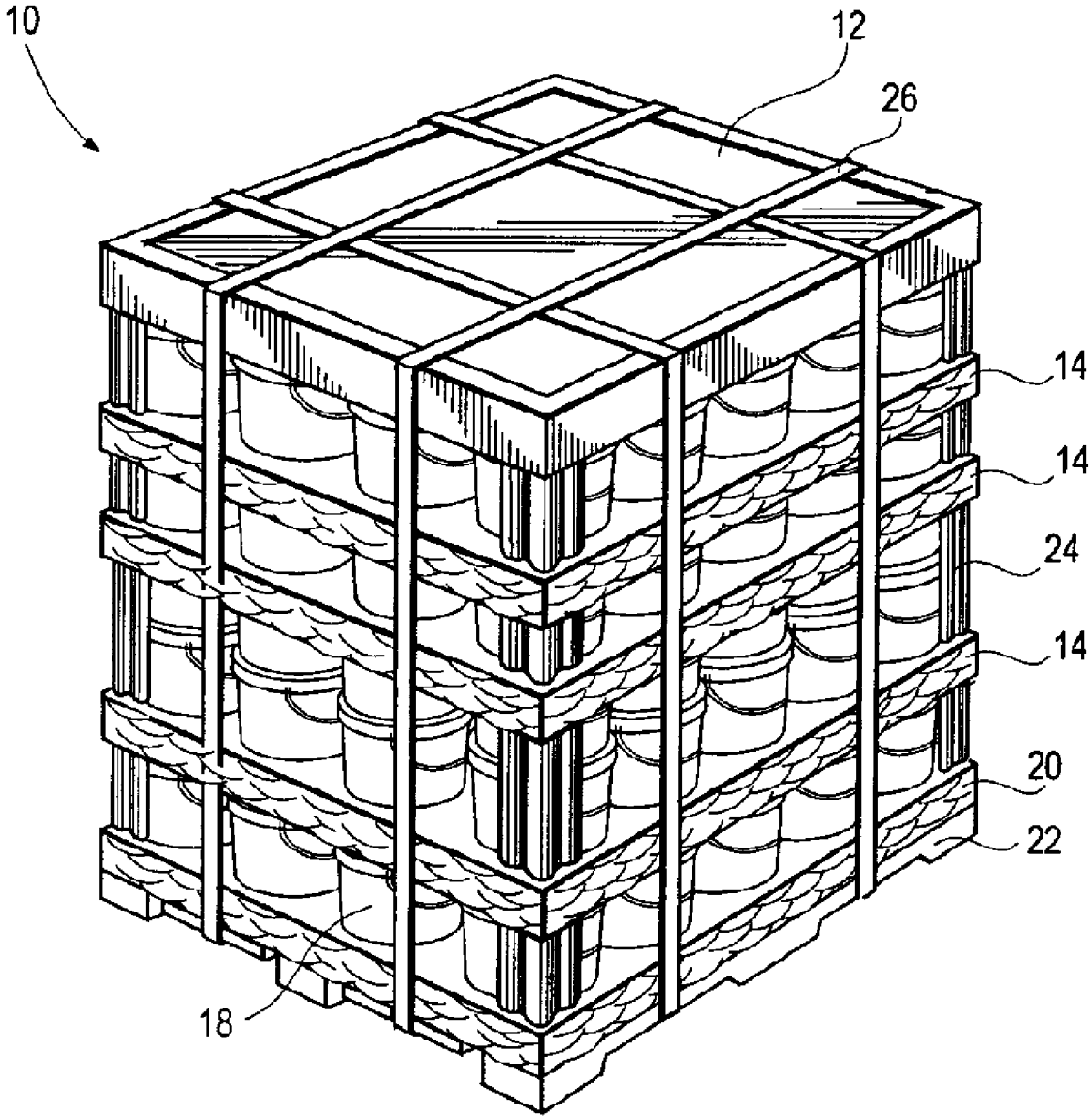
FIG. 1 is a perspective view of a modular packaging system according to the invention.

Turning to the drawings, there is shown in FIGS. 1–4 one embodiment of the invention, a packaging system for shipping and displaying palletized stacked products intended for sale in a mass merchandising environment. The packaging system 10 comprises a top cap 12, a plurality of corrugated trays 14 with openings 16 formed therein for receiving the product containers 18 and restricting their movement, a bottom tray 20, a pallet 22, and vertical support posts 24 that key inside the bottom tray 20 and top cap 12 and through the middle trays 14 to help lock the system together. The entire assembly may be held together with vertical banding 26 and wrapped in an outer wrap to protect the product from dust and damage during shipment.

The top cap 12 is conventional in design, and preferably comprises a center panel and short side panels extending downward from the periphery of the center panel. The side panels help hold the top ends of the vertical support posts 24 in position after assembly of the packaging system 10.

The product containers 18 should have a larger top than bottom. For example, the product containers 18 shown in the figures are generally bucket or pail shaped. That is, each container 18 is generally frusto-conical in shape with a larger diameter at the top than at the bottom. Each tray 14 rests on the tops of one layer of product containers 18 while restraining the movement of the containers that fit within the tray openings 16.

Figure 2:
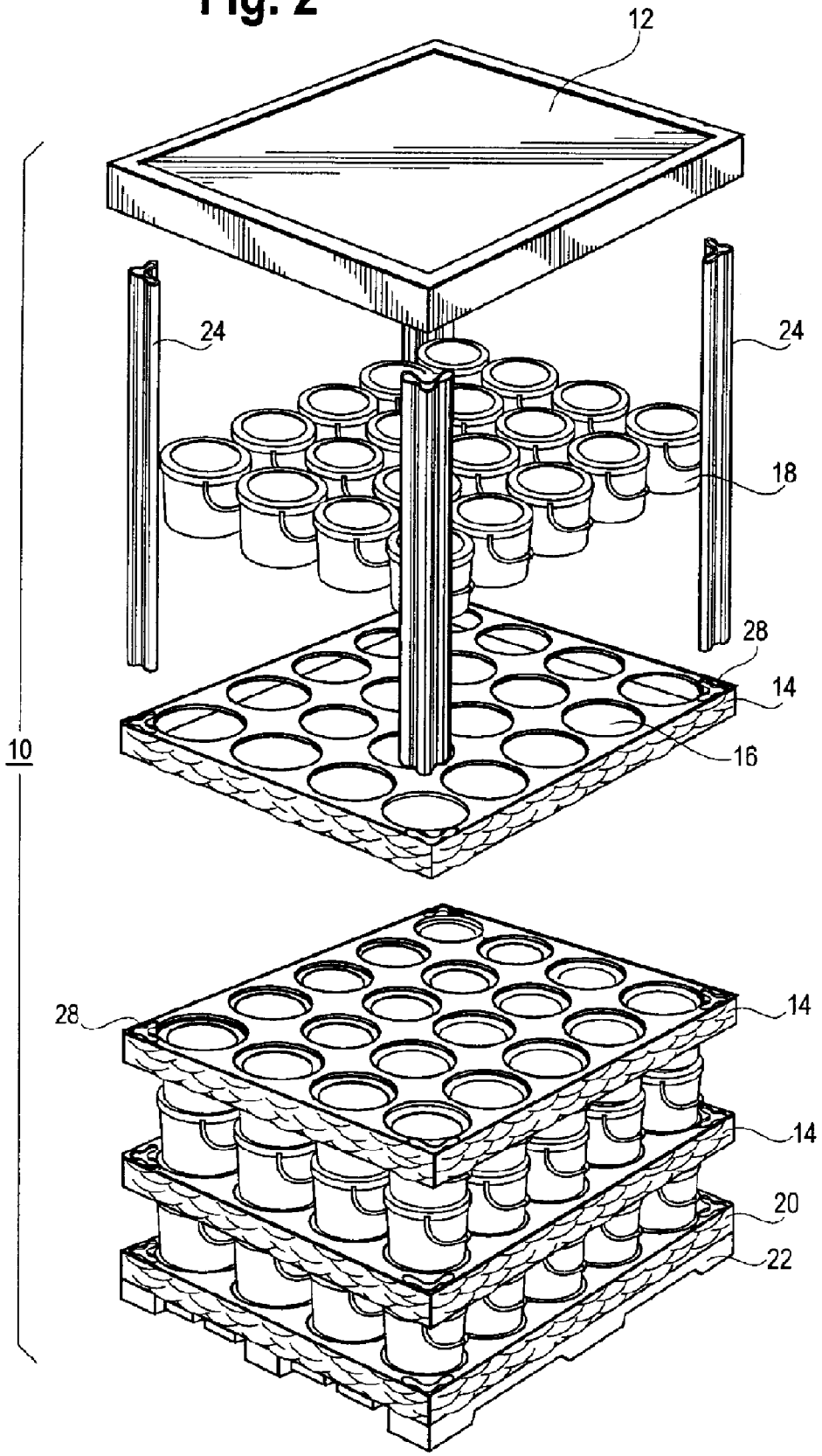
FIG. 2 is an exploded view of the modular packaging system of FIG. 1.
Figure 2A:
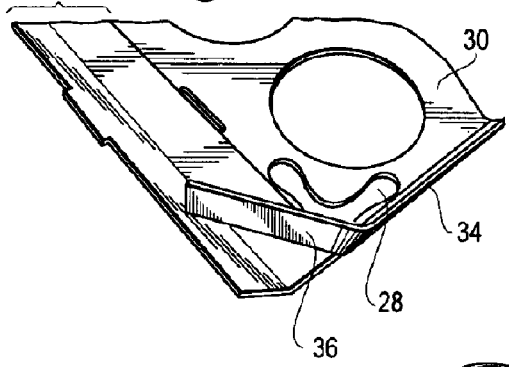
FIG. 2A is a close up view of a disassembled corner of a tray.
Figure 3:
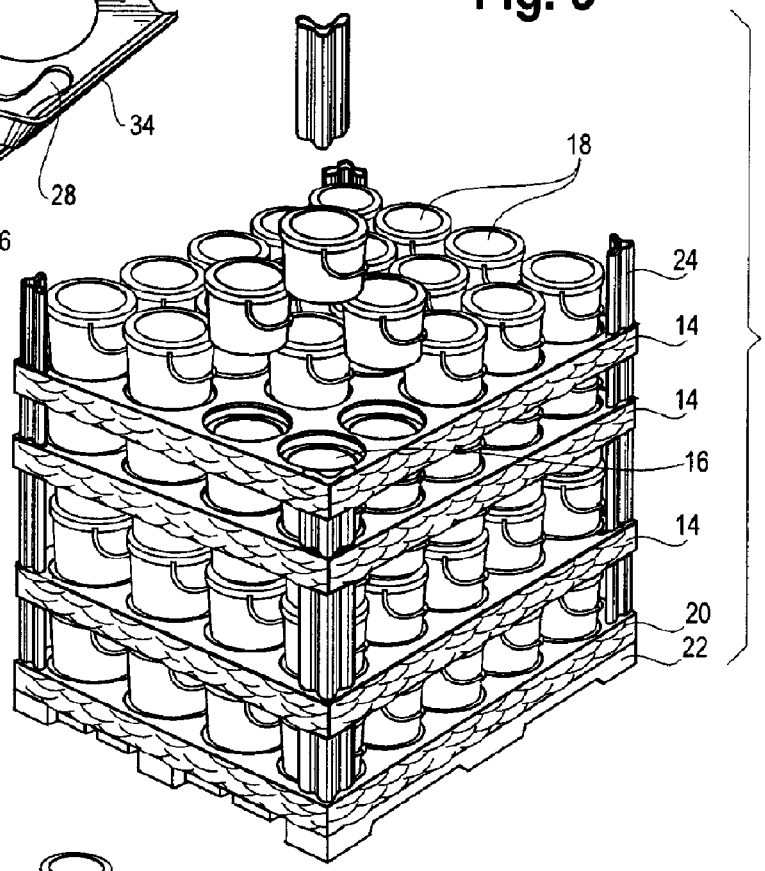
FIG. 3 is a perspective view of the modular packaging system of FIG. 1 with the top cap and several of the product containers removed and with one of the vertical support posts shown in broken view to reveal some of the container openings in the topmost tray.
Figure 4:
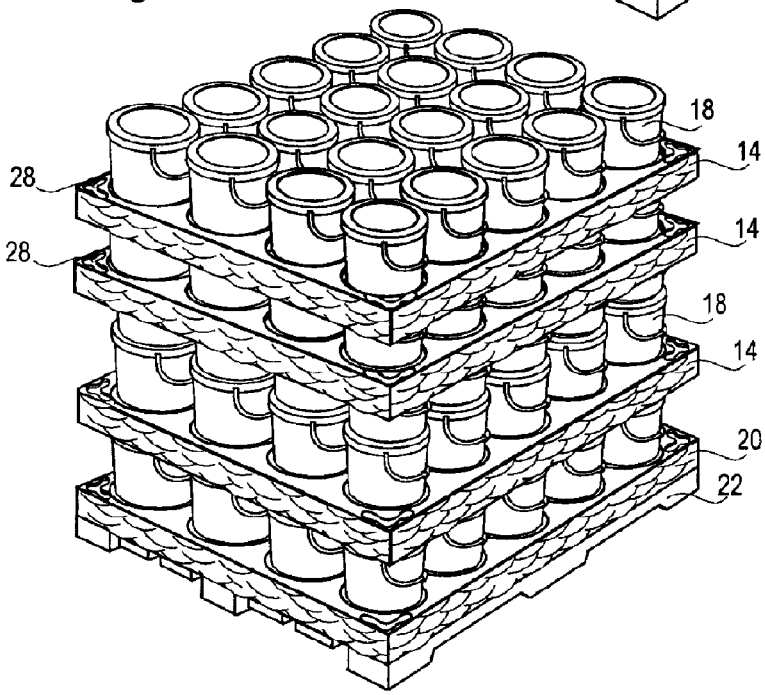
FIG. 4 is a perspective view of the modular packaging system of FIG. 1 with the top cap removed.

The trays 14 preferably are formed from corrugated board, although any suitable material may be used. As best shown in FIGS. 2 and 2*a*, each corrugated tray 14 may be made from a blank having a center panel 30, two double layer side panels 32 and two single layer side panels 34. Tabs 36 extend from each end of the single layer side panels 34. The tabs 36 are folded perpendicular to the single layer side panels 34 to fit between the folded layers of the double layer side panels 32 to form triple layer corners for extra strength. After each tray 14 is assembled, the tray 14 is flipped over so the side panels 32, 34 extend downward. The center panel 30 and/or side panels 32, 34 may be printed or otherwise decorated in any desirable fashion to increase the aesthetic appeal of the display.

The central panel 30 of each tray 14 includes die-cut openings 16 large enough to accommodate the bottoms of the product containers 18 and preferably allow for some slight lateral movement. Where the containers are tapered from top to bottom, the tray openings 18 must be at least as large as the container bottom diameter but smaller than the container top diameter. Each center panel 30 also has corner openings 28 near each corner to receive the vertical support posts 24. Preferably, the corner openings 28 are generally L-shaped to accommodate the vertical support posts 24 if the vertical support posts 24 have an L-shaped cross-section.

The bottom tray 20 should have means for holding in position the bottom ends of the vertical support posts 24. In the preferred embodiment, the bottom tray 20 is basically the mirror image of the top cap 12, comprising a center panel and short side panels extending upward from the periphery of the center panel. The bottom tray side panels help hold in position the bottom ends of the vertical support posts 24. The bottom tray center panel need not have any openings since it rests directly on the pallet 22. Alternatively, the bottom tray 20, like the other trays 14, can comprise a center panel having corner openings 28 for receiving the bottom ends of the vertical support posts 24.

Preferably, the vertical support posts 24 are hollow paper tubes formed into a desired cross-sectional shape and cut to a desired length, such as those marketed by Sonoco Products Company of Hartsville, S.C. and described in U.S. Pat. Nos. 4,482,054; 5,593,039; 6,059,104 and 6,186,329, incorporated herein by reference. In the embodiment illustrated in the figures the vertical support posts 24 have a substantially L-shaped cross-sectional profile, although any suitable cross-sectional shape may be used, including triangular, circular or rectangular. Since the vertical support posts 24 are visible to the consumer, they too may be printed or otherwise decorated in any desirable fashion to increase the aesthetic appeal of the display. The vertical support posts 24 should be strong enough to support the weight of one or more palletized units 10 stacked on top.

The vertical support posts 24 and trays 14 work together to lock the product containers 18 in place (but still allow for some slight movement of the containers 18), helping to maintain the containers 18 in neatly stacked columns. Preferably there are four vertical support posts 24 and, therefore, four corner openings 28 in each tray 14, although additional vertical support posts may be used for added stability. Where one or more units 10 is stacked on top, the vertical support posts 24 bear the entire load.

The tray and post assembly may be carried on a standard pallet 22 and wrapped in transparent plastic film to protect the containers 18 from dust and damage during shipment.

Any number of rows (layers) of containers 18 can be achieved with the invention. By way of example only, and without limitation as to the scope of the invention, to assemble the five layer packaging system 10 shown in the figures, the product wholesaler (vendor) places a bottom tray 20 on a standard pallet 22 and stacks one layer of product containers 18 on the bottom tray 20. Next, the vendor places a first corrugated tray 14 on top of the first layer of product containers 18. The vendor then stacks two layers of product containers 18 on top of the first layer of containers 18 while making sure the bottoms of the second layer of containers fit within the die cut openings 16 in the first corrugated tray 14. Next, the vendor places a second corrugated tray 14 on top of the third layer of product containers 18. A fourth layer of product containers 18 is then stacked on top of the third layer of containers 18. Then a third corrugated tray 14 is placed on top of the fourth layer of product containers 18. The vendor stacks a fifth layer of product containers 18 on top of the fourth layer of containers 18 while making sure the bottoms of the fifth layer of containers are disposed within the die cut openings 16 in the third corrugated tray 14.

The vertical support posts 24 are then inserted through the vertical support posts openings 28 in the three corrugated trays 14. The bottom ends of the posts 24 should fit within the sidewalls of the bottom tray 20. A top cap 12 is placed over the top row of product containers 18 so that its downwardly extending side panels capture the top ends of the vertical support posts 24. Optional metal or plastic banding 26 may be placed around the unit to secure it during shipping and handling. Preferably the banding 26 is placed over the top cap 12 and under the pallet 22 to tie the system together. Finally, the entire assembly 10 may be wrapped in transparent plastic film (not shown) to protect the product containers 18 from dust and damage during shipment.

When the palletized unit 10 arrives at the point of sale, the banding 26, transparent plastic film and top cap 12 are removed and the stacked product containers 18 are ready for display and sale.

Thus there has been described a stronger, safer means for packaging, shipping and displaying stacked palletized products. The system maintains the stacked product containers in neat and orderly vertical columns. Due to the high axial compression strength of the vertical support posts the system allows for stacking of multiple palletized units. The system is strong enough to withstand the vibration and impact forces that can occur during shipping, and also strong enough to withstand the weight of one or more units stacked on top. The system is particularly suited for shipping and displaying products sold in bucket or pail type containers, such as laundry detergent, where the product containers themselves bear the load of other product containers stacked on top.

Other modifications and alternative embodiments of the invention are contemplated that do not depart from the scope of the invention as defined by the foregoing teachings and appended claims. It is intended that the claims cover all such modifications that fall within their scope.

What is claimed is:

1. A packaging system for shipping and displaying multiple layers of vertically stacked product containers, the system comprising:

a plurality of layers of vertically stacked product containers as a structural component of the system, each product container having a bottom and a top, the product containers being stacked directly on top of each other so that the container bottoms are in contact with the container tops;

a plurality of trays, each tray comprising a center panel having an array of openings disposed therein for receiving and restricting the movement of the product containers, each tray further comprising corner openings for receiving vertical support posts; and vertical support posts inserted through the corner openings to lock the trays together.

2. The packaging system of claim 1 further comprising a bottom tray on which rests a first level of product containers.

3. The packaging system of claim 2 wherein the bottom tray comprises a center panel and short side panels extending upward from the center panel.

4. The packaging system of claim 3 wherein the bottom tray rests on a pallet.

5. The packaging system of claim 4 wherein each vertical support post has an upper end, the system further comprising a top cap configured to fit over upper ends of the vertical support posts.

6. The packaging system of claim 5 wherein the top cap comprises a center panel and short side panels extending downward from the center panel.

7. The packaging system of claim 6 further comprising banding disposed around the top cap and pallet to secure the system during shipping and handling.

8. The packaging system of claim 6 further comprising plastic film wrapped around the rest of the packaging system to protect the product containers from dust and damage.

9. The packaging system of claim 8 wherein the vertical support posts are hollow tubes.

10. The packaging system of claim 1 wherein each tray is formed from corrugated board.

11. The packaging system of claim 1 wherein each tray further comprises side panels extending perpendicularly from the periphery of the center panel.

12. The packaging system of claim 11 wherein the tray side panels are decorated for consumer appeal.

13. The packaging system of claim 1 wherein each tray rests on the tops of a layer of product containers.

14. The packaging system of claim 13 wherein the product containers have a larger diameter at the top than at the bottom and wherein the openings in the tray center panel are larger than the bottoms of the product containers but smaller than the tops of the product containers.

15. The packaging system of claim 14 wherein the product container tops have a raised peripheral edge and the bottoms of the product containers nest inside the tops of the product containers.

16. The packaging system of claim 1 wherein the corner openings capture the vertical support posts on all sides of the posts.

* * * * *